US005234164A

United States Patent [19]

Huhne

[11] Patent Number: 5,234,164

[45] Date of Patent: Aug. 10, 1993

[54] DEVICE FOR HIGH SPEED FLAME SPRAYING OF REFRACTORY WIRE OF POWDER WELD FILLER FOR THE COATING OF SURFACES

[75] Inventor: Erwin D. Huhne, Schallstadt, Fed. Rep. of Germany

[73] Assignee: UTP Schweibmaterial GmbH & Co. KG, Bad Krozingen, Fed. Rep. of Germany

[21] Appl. No.: 981,997

[22] Filed: Nov. 24, 1992

Related U.S. Application Data

[63] Continuation of Ser. No. 691,538, Apr. 25, 1991, abandoned.

[30] Foreign Application Priority Data

May 22, 1990 [DE] Fed. Rep. of Germany ..... 4016412

[51] Int. Cl.[5] ..... B05B 7/20; C23C 4/12

[52] U.S. Cl. ..... 239/79; 239/132.3

[58] Field of Search ..... 239/79, 83-85, 239/132.3

[56] References Cited

U.S. PATENT DOCUMENTS

| | | | |
|---|---|---|---|
| 2,544,259 | 3/1951 | Duccini et al. | 239/79 |
| 2,861,900 | 11/1958 | Smith et al. | 239/79 |
| 4,358,053 | 11/1982 | Ingham et al. | 234/79 |
| 4,666,397 | 5/1987 | Wenning et al. | 239/132.3 |
| 4,865,252 | 9/1989 | Rotolico et al. | 239/85 |
| 4,964,568 | 10/1990 | Rotolico et al. | 239/85 |
| 5,005,764 | 4/1991 | Simm et al. | 239/132.3 |
| 5,014,915 | 5/1991 | Simm et al. | 239/132.3 |

FOREIGN PATENT DOCUMENTS

| | | | |
|---|---|---|---|
| 9794 | 10/1927 | Australia | 239/83 |

*Primary Examiner*—Andres Kashnikow
*Assistant Examiner*—Karen B. Merritt
*Attorney, Agent, or Firm*—Staas & Halsey

[57] ABSTRACT

The invention relates to a process for high-speed flame spraying of refractory wire and powder weld filler for the coating of surfaces, using at least two gas mix systems operating independently of each other, with which the wire or powder spray weld filler brought into the primary chamber is melted by primary heating flames arranged concentrically around a charging channel, accelerated with the resulting high-speed flame and conveyed through an expansion nozzle into a downstream secondary combustion chamber; the latter is streamed through while the molten plastic weld filler is carried along by the primary high-speed flame at supersonic speed, which runs into an axially centrally widened, downstream and water cooled secondary expansion nozzle, or into its bore, so that in the area of radially, axially and focusingly arranged secondary fuel gas-oxygen channels running into the secondary combustion chamber a partial vacuum area is produced and a hot gas mixture with low streaming pressures can be added, whereby in the secondary chamber radially, axially around the primary high-speed flame the heating gas mixture ignites, expands and because of a high flame temperature and extreme rates of flame propagation and combustion contributes to melting the remainder of the spray weld filler and to its additional acceleration.

5 Claims, 13 Drawing Sheets

FLAME TEMPERATURES OF FUEL GAS/OXYGEN MIXTURES

*MIXTURE I ACCORDING TO TRG 103

21.5 - 22.5% ACETYLENE
71.5 - 73.5% ETHYLENE
5.0 - 6.0% PROPYLENE

PRIMARY FLAME YIELD OF FUEL GAS/OXYGEN MIXTURES

*MIXTURE I ACCORDING TO TRG 103

21.5-22.5% ACETYLENE
71.5-73.5% ETHYLENE
5.0- 6.0% PROPYLENE

RATE OF FLAME PROPAGATION OF FUEL GAS/OXYGEN MIXTURES

*MIXTURE I ACCORDING TO TRG 103
21.5 - 22.5% ACETYLENE
71.5 - 73.5% ETHYLENE
5.0 - 6.0% PROPYLENE

DEVICE FOR HIGH SPEED FLAME SPRAYING OF REFRACTORY WIRE OF POWDER WELD FILLER FOR THE COATING OF SURFACES

This application is a continuation of application Ser. No. 07/691,538, filed Apr. 25, 1991, now abandoned.

BACKGROUND OF THE INVENTION

The invention relates to a process and a device for high-speed flame spraying of refractory wire or powder weld filler for the coating of surfaces, in which an all-gas high-speed flame spray burner is used to coat surfaces with any refractory wire or powder spray weld filler.

In that regard two or more gas mixing systems that operate independently from each other, which can operate with different fuel gas-oxygen mixtures, are integrated in the device.

A multiplicity of processes, devices and technologies are known from prior state of art that no longer meet the high requirements of modern technology.

DE-PS 81 18 99 proposes an arrangement for atomizing metallic and non-metallic substances, which can be viewed as the basic principle for high-speed spraying using fuel gas and oxygen. The arrangement primarily involves a system comprised of a combustion chamber and expansion nozzle, with which wire, powder or molten spray weld fillers can be sprayed using primarily hydrogen as detonating gas. Therefore, when using the proposed device, only one heating or fuel gas, primarily hydrogen, can be used each time, which according to the compressed gas principle is introduced into the combustion chamber. According to DE-PS 81 18 99, the ignition of hydrogen is done manually when emerging from the expansion nozzle, electrically by short circuit or by means of an electric arc.

Hydrogen can be ignited by means of the molten heated spray weld filler, which is combined with the detonating gas through the combustion chamber via an access.

The design concept proposed in DE-PS 81 18 99 in many respects does not meet the requirements imposed today on high-speed flame spray equipment.

On the one hand the fuel gas, which according to DE-PS 81 18 99 is hydrogen, is introduced according to the compressed gas principle into the combustion chamber, which no longer fulfills either the legal type approval requirements for autogenous burners or accident prevention provision UW-VGB 15.

In addition, hydrogen without additional oxidation gas, such as oxygen, does not produce sufficient heat to be able to spray refractory spray weld fillers such as molybdenum, wolfram and oxides. On the other hand, hydrogen burns reducing and for that reason is unsuitable for spraying metal oxides, since the hydrogen flame takes oxygen from the spray weld filler in the molten or plastic state.

Another high-speed flame spray system is known from EP-O 049 915. This high-speed flame spray system has a water cooled expansion nozzle that is supposed to be suitable for spraying wire or powder weld fillers. In contrast to the concept of DE-PS 81 18 99, the heating gas used may be optionally nitrogen, propane or MAPP gas, in addition to oxygen. The individual fuel gases are introduced according to the compressed gas principle into a large mixing chamber and mixed with oxygen. The fuel gas-oxygen mixture moves through bores into the water cooled expansion jets, where it is combined in the combustion chamber with the powder or wire weld filler.

This method in accordance with EP-A1-0 049 915 also suffers from numerous technical applications and safety problems.

The design concept proposed in EP-A1-0 049 915 precludes the use of acetylene as heating gas, since, because of the high rate of flame propagation of acetylene, the risk of flame backfire or backflash, due to the compressed gas principle, is extremely high.

Excluding the use of acetylene in connection with oxygen significantly limits applications, since due to the high flame energy particular weld fillers such as refractory metals and oxides can be sprayed and melted only with an acetylene-oxygen flame at 3160° C. The extremely high rate of flame propagation of an acetylene-oxygen mixture, approximately 11.5 m/sec., compared with propane-oxygen, which in a mixture ratio of 1:5 is about 3.6 m/sec., which results in practice in significantly higher rates of flame propagation and therefore higher kinetic particle speeds, cannot be taken advantage of in the proposed system. Gas mixing systems of the type described above do not fulfill the accident prevention requirements of VGB 15 nor the type approval requirements for autogenous devices.

The acetylene-oxygen flame possesses dominant properties that cannot be obtained by any other fuel gas-oxygen mixtures. For that reason it is ideal for thermal spraying of refractory weld fillers.

However, the use of acetylene as a heating gas to operate high-speed flame spray systems in connection with oxygen is problematic due to the specific structure of the acetylene molecule.

Acetylene is a chemical combination of carbon and hydrogen. It is so-called unsaturated hydrocarbon, whose molecule possesses an inner tension and seeks equilibrium. Therefore, acetylene is not a stable substance, but instead is inclined to decompose into its components, i.e. carbon and hydrogen. For example, when acetylene is heated to a temperature of about 300° C., and if it is also under pressure, then any decomposition initiated will be continued by the entire gas quantity. The energy released in the form of heat is sufficient to bring neighboring acetylene particles to decomposition temperature. That process occurs so rapidly that when decomposition is initiated compressed acetylene decomposes in an explosive manner. That condition can occur, for example, if acetylene is introduced into a combustion chamber of a high-speed burner and is ignited; the expansion produces a combustion chamber pressure in the order of magnitude between 2 and 3.5 bar, so that because of the backdraft on the fuel gas line the aforementioned acetylene decomposition occurs.

Because of the condition described above, back-ignition in the gas mixture area occurs where fuel gases, in this case acetylene and oxygen, are combined. The aforementioned negative occurrence prevents the fuel gas, acetylene and oxygen from combusting in the combustion chamber and in that way a high-speed flame can be produced.

Moreover, it is known that in the current state of the art oxide-free spray coatings, such as those made of hastelloy, tribaloy or extremely pure nickel can only be produced using plasma vacuum chamber spraying. That technology is very complex and extremely cost intensive.

SUMMARY OF THE INVENTION

The present invention is therefore intended to create a process and device that make(s) it possible to operate with acetylene and oxygen without difficulty.

In addition, the present invention is intended to simplify the coating process significantly and to reduce costs and simultaneously improve coating quality in regard to optimization of the adhesive strength of the weld filler to the substrate, by achieving a significantly higher kinetic energy of the flame jet, so that at the same time lower porosity and thus higher impermeability of the spray layer are achieved.

This aim is reached by the process of the invention, as well as by the device to perform the process, and particular characteristics of embodiments of the invention are described herein.

The intention of the invention is that the process for high-speed flame spraying of refractory wire and powder weld filler for the coating of surfaces operates using at least two gas mix systems operating independently of each other, with which the wire or powder spray weld filler brought into the primary chamber is melted by primary heating flames arranged concentrically around a charging channel, accelerated with the resulting high-speed flame and conveyed through an expansion nozzle into a downstream secondary combustion chamber; the latter is streamed through while the molten plastic weld filler is carried along by the primary high-speed flame at supersonic speed, which runs into an axially centrally widened, downstream and water cooled secondary expansion nozzle, so that in the area of radially, axially and focusingly arranged secondary fuel gas-oxygen channels running into the secondary combustion chamber a partial vacuum area is produced and a hot gas mixture with low streaming pressures can be supplied, whereby in the secondary chamber radially, axially around the primary high-speed flame the heating gas mixture ignites, expands and because of a high flame temperature and extreme rates of flame propagation and combustion contributes to melting the remainder of the spray weld filler and to its additional acceleration.

Preferably the primary gas mixture occurs in the intermediate piece designed as an injector gas mixing block and the secondary gas mixture occurs in the primary combustion chamber housing designed as a mixing block for secondary gases. A particularly preferred embodiment of the invention provides for the primary heating gas mixture following directly in a gas mixing block according to the injector principle in the direct vicinity of the primary combustion chamber. In a particularly preferably embodiment of the invention the primary combustion chamber and/or the expansion nozzle in the secondary injector gas mixing block is (are) integrated in the secondary injector gas mixing block. Alternatively, it is possible to add the spray weld filler, which may be in the form of powder and the powder transport gas at room temperature or the powder spray weld fillers and/or the powder transport gases preheated. Here the connection for the spray weld filler and/or powder transport gases is equipped with a water cooling system. The cold or preheated spray weld filler is melted on when being conveyed through the primary combustion chamber, brought through the primary heating flame through the secondary combustion chamber, melted and accelerated and exits through the expansion jet bore with the secondary flame.

In the proposed device to perform the process it is foreseen that the device is designed as a flame spray gun and is comprised of a device base body, operating components-connector block with distributor chambers, injector gas mixing block, combustion chamber housing and a central bore for spray weld fillers and cooling equipment and beginning from the operating components-connector block the secondary gas, secondary heating gas, primary gas and primary gas channels are led respectively, separately to a primary fuel gas chamber and a secondary fuel gas chamber, whereby the spray weld filler channel surrounded by the primary gas channels leading out into the primary combustion chamber and the secondary gas channels leading out through the primary combustion chamber in the direction of the expansion nozzle run into the secondary combustion chamber.

A preferred embodiment of the invention is characterized in that the device is comprised of an operating components-connector block, a device base body, a gas mixing block support, an injector gas mixing block, a primary combustion chamber housing with internal part or central bore body, press-in screw and hasp part, as well as secondary expansion nozzle body, internal screw sleeve and external screw sleeve.

It is preferably foreseen that the operating components-connector block has at least one each cooling water connector, a secondary gas connector, a primary gas connector, a connector for powder weld fillers and for wire spray fillers, a primary heating gas connector, a secondary heating gas connector and a cooling water backflow connector, which continue as channels up to the face surface of the operating components-connector block or the distributor chambers arranged there.

These channels or the distributor chambers of the operating components-connector block correspond with same-medium channels of the device base body, which is connected on the operating component-connection block.

The device base body receives at least partially a gas mixing block support for secondary gases, and an injector gas mixing block for primary gases is arranged in the gas mixing block support.

Another particularly preferably embodiment of the invention consists of the device base body having channels that correspond with the channels or with the ring channels arranged on the face surface of the operating components-connector block.

An additional embodiment consists of having the channel of the device base body running in a cooling water advance channel between the internal screw sleeve and the external screw sleeve, while the cooling water backflow channel corresponds with the cooling water backflow channel formed between the device base body and the press-in screw.

The gas mixing block support is preferably interspersed with at least one each secondary gas and secondary heating gas channel, in which each corresponds on one side with the same-medium channels of the device base body and on the side facing the primary combustion chamber runs into radial grooves arranged there for secondary heating gas and secondary gas.

The injector gas mixing block for primary gases has at least one each primary heating gas channel and one primary gas channel as well as a central bore for spray weld fillers, whereby these channels correspond on one side with the same-medium channels of the device base body, and the primary gas channel runs into a radial annulus between the gas mixing block support and the injector gas mixing block or the channel for primary heating gas runs into an annulus for oxygen distribution, while the central bore leads up to the face side of the injector gas mixing block and starting from the annulus for oxygen distribution, injector nozzle bores are conducted to the injector gap, from which injector mixing nozzle bores continue to a radial groove.

It is preferably contemplated that the injector gas mixing block in the direction of the expansion jet is connected to a primary combustion chamber housing, which receives an internal part with injector gas mixing bores as well as a bore for the spray fillers.

In that regard the injector gas mixing bores are arranged focusing and/or axially in the internal part.

On the face side of the internal part facing the injector gas mixing block a radial ring groove for fuel gas, oxygen-primary gas is arranged, which corresponds with the radial ring groove of the injector gas mixing block, as does the centrally arranged bore for spray weld fillers of the internal part with the central bore of the injector gas mixing block.

It is preferably envisioned that the primary combustion chamber housing on the face side facing the gas mixing block support has one each radial ring groove for secondary heating gas and one radial ring groove for secondary heating oxygen, which correspond with the same-medium radial grooves of the mixing block support.

The individual corresponding channels continue from these radial ring grooves, and the latter converge in a radial ring groove (injector gap), since the channels lead directly to or through injector pressure nozzle bores into the radial ring groove.

In that regard it is envisioned that these channels are formed at least partially by the gap between the primary combustion chamber housing and the hasp part.

Commencing from the radial ring groove, axial and focusing bores lead to the secondary combustion chamber.

These bores lead away through the primary combustion chamber.

The expansion jets are contiguous to the secondary combustion chamber.

The cooling water channel proceeds, commencing at the connection of the operating components-connector block, through the device base body, between the internal screw sleeve and the external screw sleeve, to the radial bore on the expansion jet outlet bore and then over into the cooling water backflow, since the cooling water channel extends between the expansion nozzle body and the internal screw sleeve and merges into a cooling water annulus, and from there a cooling water channel leads to the cooling water backflow connector of the operating components-connector block.

Additional particularly advantageous embodiments of the invention are characterized in that the primary combustion chamber housing is designed as secondary gas mixing block. The primary combustion chamber of the combustion chamber housing has a transitional expansion nozzle bore.

Using the attached illustrations showing specific embodiments of the invention, the latter are explained in greater detail, as follows:

DESCRIPTION OF THE PREFERRED EMBODIMENTS

Figure 1:
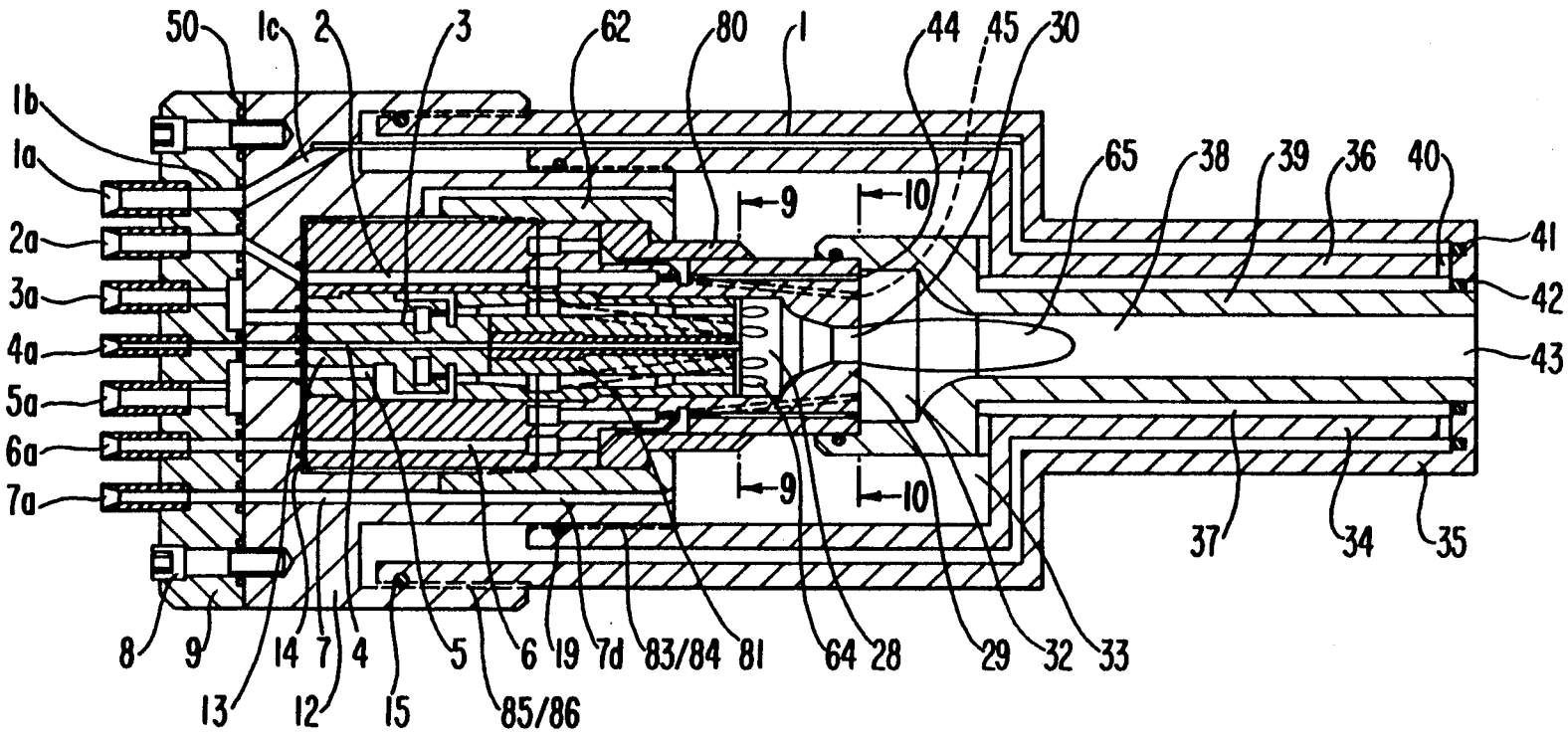
FIG. 1 shows a cross-section of the device in accordance with the invention.

FIG. 1 shows the device in accordance with the invention for high-speed flame spraying, which is designed as a flame spray gun.

The device is comprised of an operating components-connector block 9, a device base body 12, an internal mixing nozzle block/injector gas mixing block for primary gases 13 and gas mixing block support 14, a primary combustion chamber housing 29 with hasp part 80 and press-in screw 62, expansion nozzle body 39 and an internal screw sleeve 34 and external screw sleeve 35 surrounding it as well as an internal part 76 receiving the central bore body 81.

The device is interspersed with a cooling water advance channel 1, a secondary gas channel 2, a primary gas channel 3, a central bore for weld fillers (in the form of powder or wire) 4, a primary heating gas channel 5, a secondary heating gas channel 6 and a cooling water backflow channel 7. The primary gas and the primary heating gas are mixed in the injector gas mixing block for primary gases 13 and enter into the primary combustion chamber 28, whereby the wire or powder spray weld filler also introduced into primary combustion chamber 28 is melted by primary heating flames 64 arranged concentrically around charging channel 4, with the resulting high-speed flame 65 accelerated and conducted through a primary expansion nozzle bore 30 into a downstream secondary combustion chamber 32. The latter is streamed through while the molten plastic weld filler is carried along by primary high-speed flame 65 at supersonic speed, which runs into an axially centrally widened, downstream and water cooled secondary expansion nozzle 39 or into its bore 38, so that in the area of secondary fuel gas-oxygen combustion channels 44, 45, which are arranged in a radial, axial and/or focusing manner and run into secondary combustion chamber 32, a partial vacuum zone is produced and a hot gas mixture with low streaming pressures can be supplied, whereby in secondary chamber 32 radially, axially around the primary high-speed flame 65 the hot gas mixture ignites, expands and because of a high flame temperature and an extreme rate of flame propagation and combustion contributes to melting the remainder of the spray weld filler and to its additional acceleration.

External screw sleeve 35 here surrounds internal screw sleeve 34 in such a way that an annulus 36 is formed for the cooling water advance. Internal screw sleeve 34 has an internal threading 83, and can therefore be screwed onto external threading 84 of device base body 12 and sealed by means of O-ring 19. External screw sleeve 35 has external threading 85, which engages in an internal threading 86 of device base body 12 and is therefore screwed into the latter. Here, too, an O-ring 15 is included for sealing purposes. By means of this arrangement annulus 36, which is generally designated with reference number 1, of the cooling water advance is continued up to device base body 12. In the region of expansion nozzle outlet bore 43 O-ring seals 41 and 42 are also arranged between external screw sleeve 35 and internal screw sleeve 34 as well as between internal screw sleeve 34 and expansion nozzle body 39.

Commencing at annulus 36 a cooling water channel 1*c* leads through device base body 12 up to cooling water channel 1*b* of the operating component-connector block 9, which has a connection for cooling water access 1*a*.

Operating component-connector block 9 is secured by means of countersunk screws 8 on device base body 12 and sealed by means of O-rings 50, which each surround and seal connecting channels 1*a* through 7*a* as well as screws 8.

Inside of internal screw sleeve 34 is located expansion nozzle body 39, which is screwed onto the internally located primary combustion chamber housing 29.

Here in turn an annulus 37 is formed for cooling water backflow between expansion nozzle body 39 and internal screw sleeve 34. The latter in turn merges into a larger annulus 33, in which cooling water channel 7*d* commencing from device base body 12 and operating components-connector block 9, runs here into channel 7*a*.

Here cooling channel 7*d* continues through the gap between device base body 12 and press-in screw 62 up to annulus 33.

In that fashion the cooling system proceeds in the following way: Beginning from cooling water connector support 1 of the operating components-block 9, cooling water flows through the cooling water inlet channel 1*a* into cooling water advance channel 1*b* of the device base body via annulus 36, divided between external screw sleeve 35 and internal screw sleeve 34 to the radial bores for cooling water 40 (cooling water advance) on expansion nozzle 39. The cooling water flows through annulus 37 between expansion nozzle 39 and internal screw sleeve 34 through cooling water channel 7*d* back to connector support 7 for cooling water backflow.

Based on FIGS. 2 and 3, as well as details 4 through 8, the two independently operating gas mixing systems in this embodiment of this invention will be described in greater detail. The description relates to the device as shown in FIG. 1.

Figure 2:
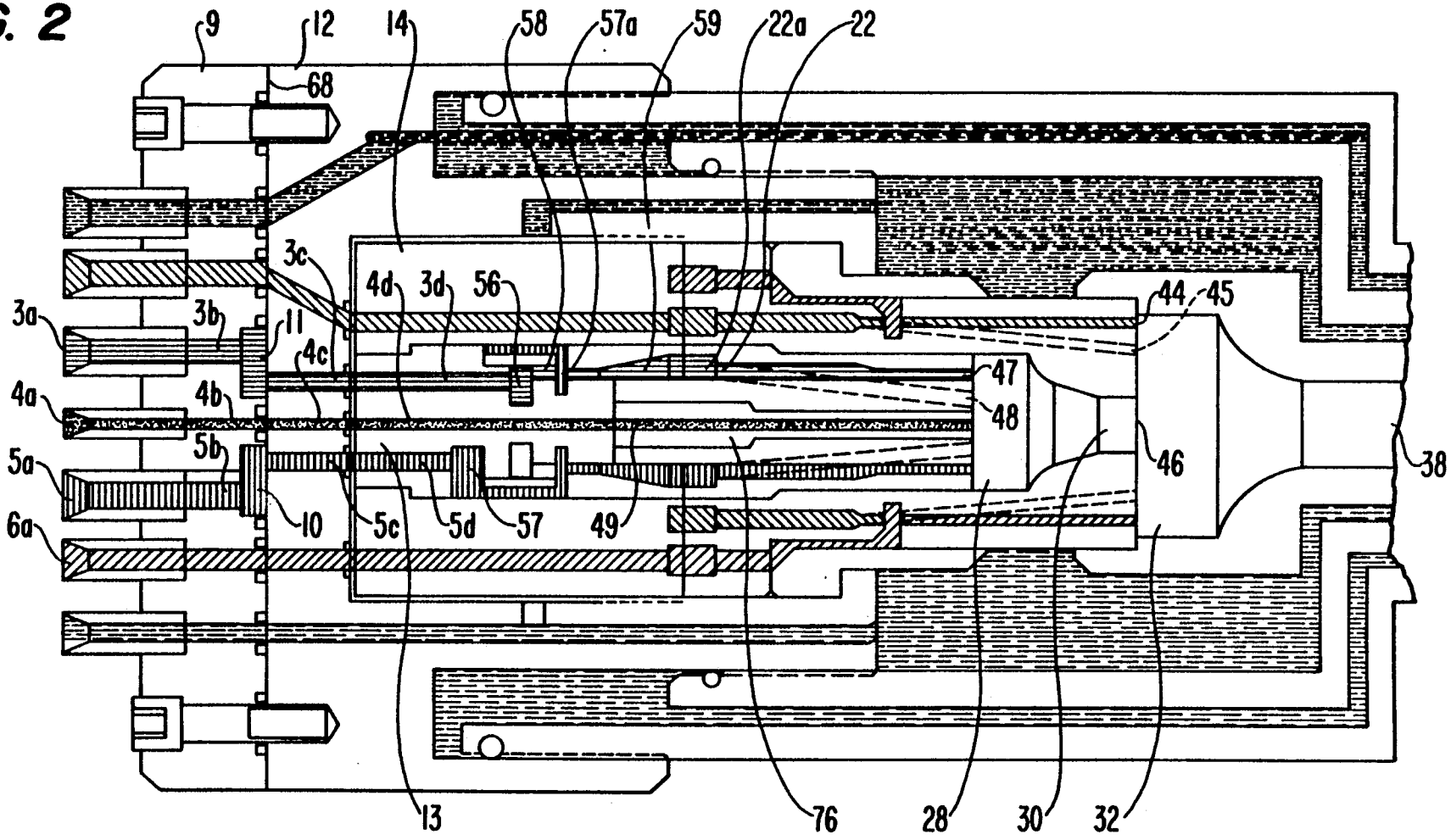
FIG. 2 shows an enlargement of FIG. 1 illustrating the primary system.
Figure 3:
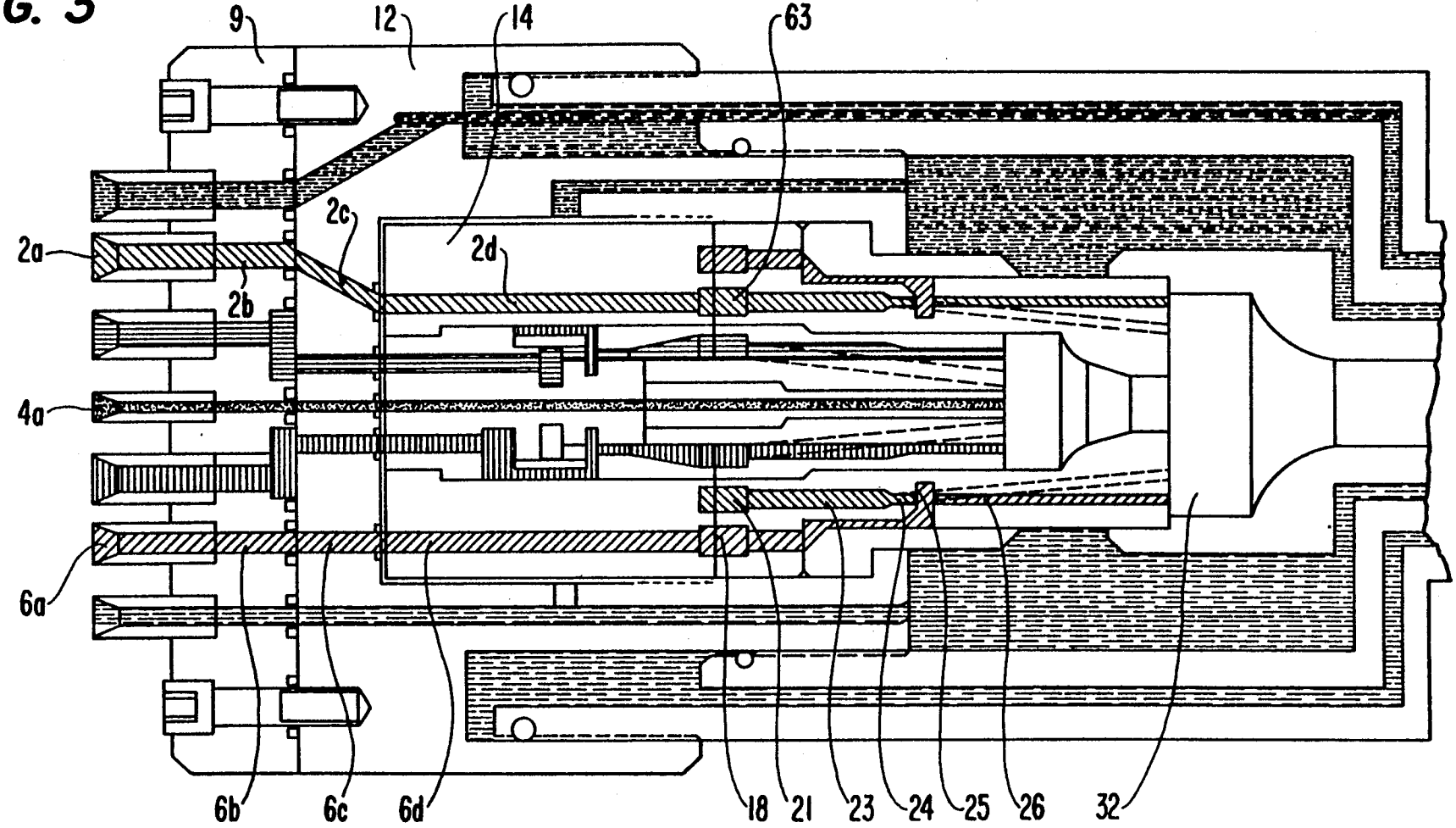
FIG. 3 shows an enlargement of FIG. 1 illustrating the secondary system.

In FIGS. 2 and 3 the cooling water advance is indicated with broken lines and cooling water backflow is indicated with dash-dot lines. The secondary gas path is shown by wavy lines running diagonally from the upper left to the lower right and the secondary heating gas path is shown with wavy lines running diagonally from the lower left to the upper right. The primary gas path was illustrated with horizontal wavy lines and the primary heating gas movement was shown with vertical wavy lines, with the intersecting wavy lines indicating the mixture. In the central bore the spray weld filler is indicated with dots.

In regard to FIG. 2, reference is first made to the primary system. Here operating components-connector block 9 has for example, inter alia a connector 3*a* for heating oxygen (primary gas) and a connector 5*a* for fuel gas H2, propane, etc. (primary heating gas).

From connector 3*a* for heating oxygen (primary gas) a canal 3*b* runs through operating components-connector block 9 into an oxygen distributor chamber 11, on face side 68 of the operating components-connector block 9 facing device connector block 12.

Primary heating oxygen channel 3 is formed by individual channels 3*c* in device base body 12 and channel 3*d* and in injector gas mixing block 13. In that regard channel 3*c* runs into oxygen distributor chamber 11 and channel 3*d* runs into annulus 56 for oxygen distribution in the internal mixing nozzle block or injector gas mixing block 13. From connector 5*a* for fuel gas, a channel 5*a* leads within operating components-connector block 9 into a fuel gas distributor chamber 10, which is also arranged on face surface 68 of operating components-connector block 9. From there channel 5*c* in device base body 12 leads to channel 5*d*, which runs into annulus 57.

Oxygen distribution occurs in annulus 56, and it functions as a pressure equalization chamber. Through injector pressure nozzle bores 58 the oxygen streams through the ring groove (injector gap) 57*a* connected to annulus 57, and thereupon streams through the various injector mixing nozzle bores 59, with the fuel gas out of the injector gap (annulus 57*a*) being carried along. The fuel gas-oxygen mixture moves through radial ring groove 22/22*a* through fuel gas-oxygen mixture bores 47 and 48 into primary gas combustion chamber 28. Fuel gas (primarily hydrogen, propane gas or propylene) is added at connector 5 and moves through fuel gas distributor chamber (pressure equalization chamber) 10 through connector bores 5*c*/5*d* into radial annulus 57 into radial ring groove 57*a*, injector gap, from which the fuel gas, due to the injector effect of the oxygen streaming through at supersonic speed, is carried along into injector mixing bores 59 and mixed. The fuel gas-oxygen-primary mixture moves through bores 47 and 48 into primary combustion chamber 28.

The injector effect in the internal gas mixing block is obtained due to the higher streaming pressure of oxygen compared with the fuel gas streaming pressure. If the primary fuel gas-oxygen mixture coming from expansion nozzle bore 43 (see FIG. 1) is ignited, the flame flashes back into primary combustion chamber 28. From cylindrical combustion chamber bore 30 or 46 the fuel gas-oxygen mixture now burns out as primary high-speed flame through secondary combustion chamber 32 into water cooled expansion nozzle bore 38. In the junction area of secondary gas mixing bores 44, 45, which are arranged concentrically, axially and focusingly around primary combustion chamber bore 46 a partial vacuum zone is produced due to the high rate of combustion of the primary heating gas flow.

The secondary system will now be described in greater detail in reference to FIG. 3. At connector 2*a* secondary heating oxygen is supplied and moves through channels 2*b*, 2*c*, 2*d* into radial ring groove 63/21 (pressure equalization and distributor ring groove). The oxygen moves through the oxygen connector bores into a multiplicity of injector pressure gas bores 24, in which it is accelerated to supersonic speed and streams through ring groove 25 (injector gap), carries along fuel gas from ring groove 25 and runs into the opposing axially and/or focusingly aligned mixing bores 26 and emerges as a fuel gas-oxygen mixture from mixing bores 44 and 45. The outflow is positively affected by the partial vacuum zone in the inlet area produced by the primary high-speed flame. The fuel gas-oxygen mixture (primarily acetylene-oxygen mixture) flowing into combustion chamber (secondary) 32 ignites at the primary high-speed flame and optimizes the melting process of the spray particles and increases the rate of combustion and spray particle speed.

In that regard, operating components-connector block 9 has connector 2a for heating oxygen (secondary gas) and connector 6a for fuel gas C2, H2 (secondary gas), from whence channels 2b and 6b lead through operating components-connector block 9 on the face side (68).

From there, within device base body 12, from channel 2b a channel 2c leads to channel 2d of gas mixing block support 14 and a channel 6c leads from channel 6a to channel 6d of gas mixing block support 14. Channel 2d leads in turn into a radial ring groove 63 or 21 and channel 6d leads into radial groove 18. Here same-medium radial grooves of gas mixing block support 14 correspond with the radial grooves of primary combustion chamber housing 29, as is also the case in the primary system. Heating oxygen (secondary gas) streams through bores 23 of the secondary heating substance through injector pressure nozzle bores 24, half of which are in focusing position and half in axial position, into radial ring groove 25 (injector gap), from whence the mixture continues through bores 44 and 45, as described.

FIGS. 2 and 3 also show central bore 4 for powder weld filler or wire spray filler.

For supply purposes a connector 4 is arranged on operating components-connector block 9, from which connector channel 4b continues to face side 68, where it leads into a channel 4c of device base body 12 or corresponds with the latter. Channel 4d, which corresponds with bore 49 of the central bore body 76, then continues in injector gas mixing block 13.

Figure 9:
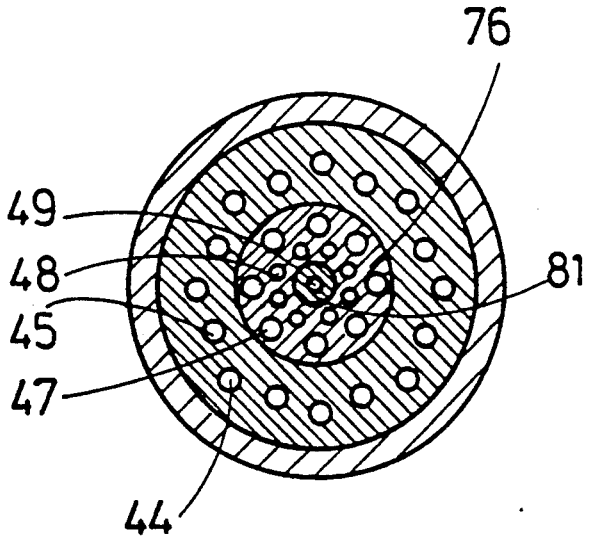
FIG. 9 shows a cross-section along line A—A as shown in FIG. 1.
Figure 10:
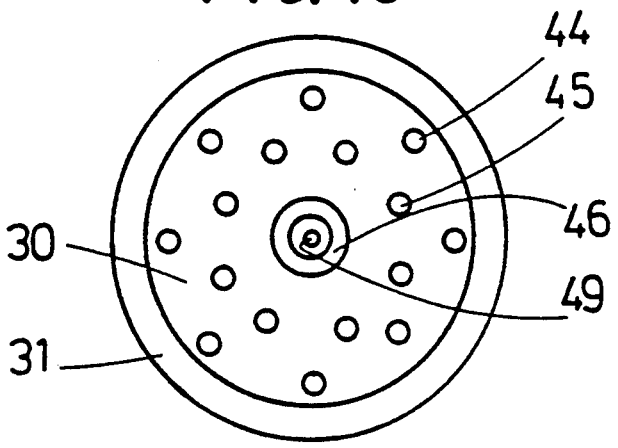
FIG. 10 shows a cross-section along line B—B as shown in FIG. 1.

FIG. 9 shows a section along line A—A in FIG. 1 and FIG. 10 shows a section along line B—B in FIG. 1.

In FIG. 9 can be seen the junction area of the primary gas streams into the primary combustion chamber, while FIG. 10 shows a top view of the junction area of the secondary gas flows.

FIG. 9 thus shows outlet bores 44 for the secondary heating gas-oxygen mixture (axial) and outlet bores 45 for the secondary heating gas-oxygen mixture (focusing).

In addition, reference number 47 shows the location of the injector gas mixing bores for the primary heating gas-oxygen mixture (axial) and reference number 48 shows such bores (focusing). Reference number 49 indicates the outlet bores for spray fillers and reference number 81 the central bore body.

In FIG. 10 the secondary combustion chamber housing is referenced by number 31, and the primary expansion nozzle bore by number 30, while reference number 44 indicates the outlet bores for the secondary heating gas-oxygen mixture (axial) and number 45 indicates those outlet bores (focusing).

The primary flame outlet-expansion nozzle bore is labelled with number 46 and the outlet bore for spray fillers is referenced by number 49.

Figure 4:
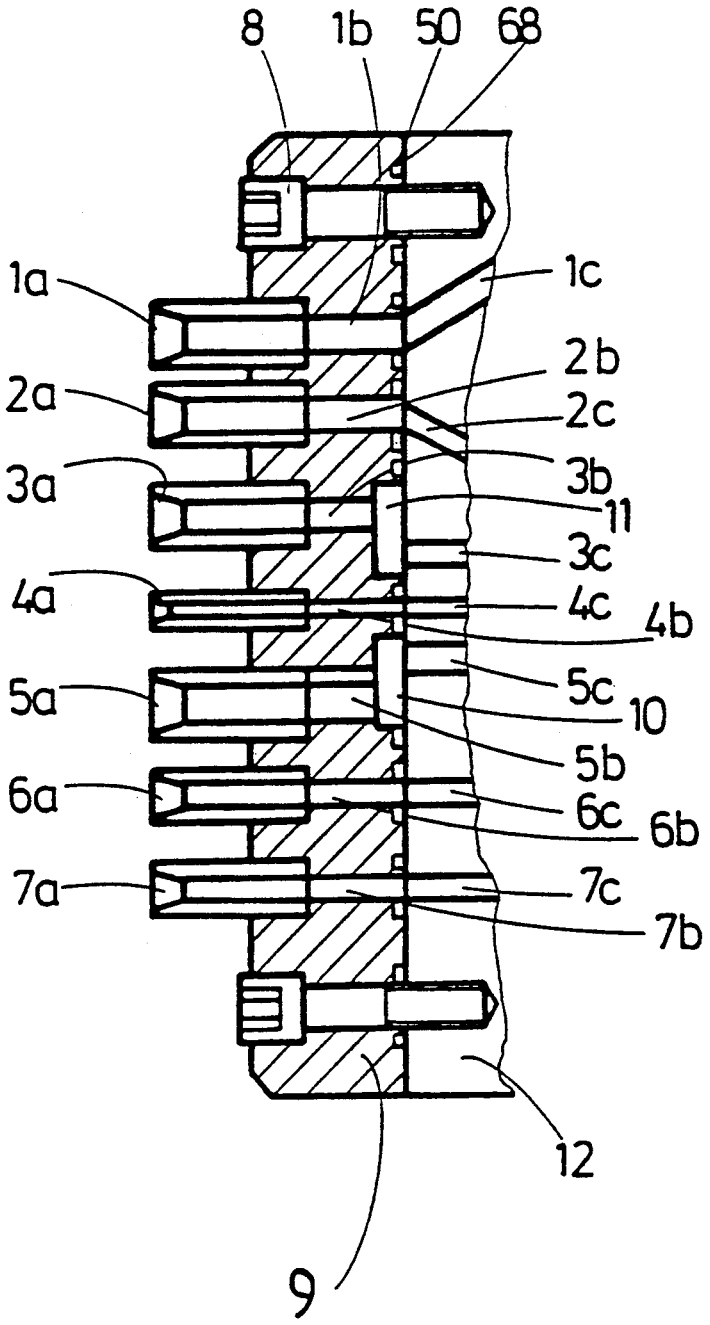
FIG. 4 shows the operating components-connector block 9.

FIG. 4 illustrates operating components-connector block 9. It has cooling water advance connector 1a, secondary gas connector 2a, primary gas connector 3a, charging channel connector 4a, primary heating gas connector 5a, secondary heating gas connector 6a and cooling water backflow connector 7a. Elements 1a–7a are coupled to corresponding elements 1b through 7b in operating components-connector block 9, which are in turn coupled to corresponding elements 1c through 7c of device base body 12.

Primary gas channel 3b and primary heating gas channel 5b lead into an oxygen distributor chamber 11 or fuel gas distribution chamber 10, and the latter then corresponds with same-medium channels 3c or 5c. By means of screws 8, operating components-connector block 9 is connected to device base body 12 and sealed by O-rings to its frontal surface.

Figure 5:
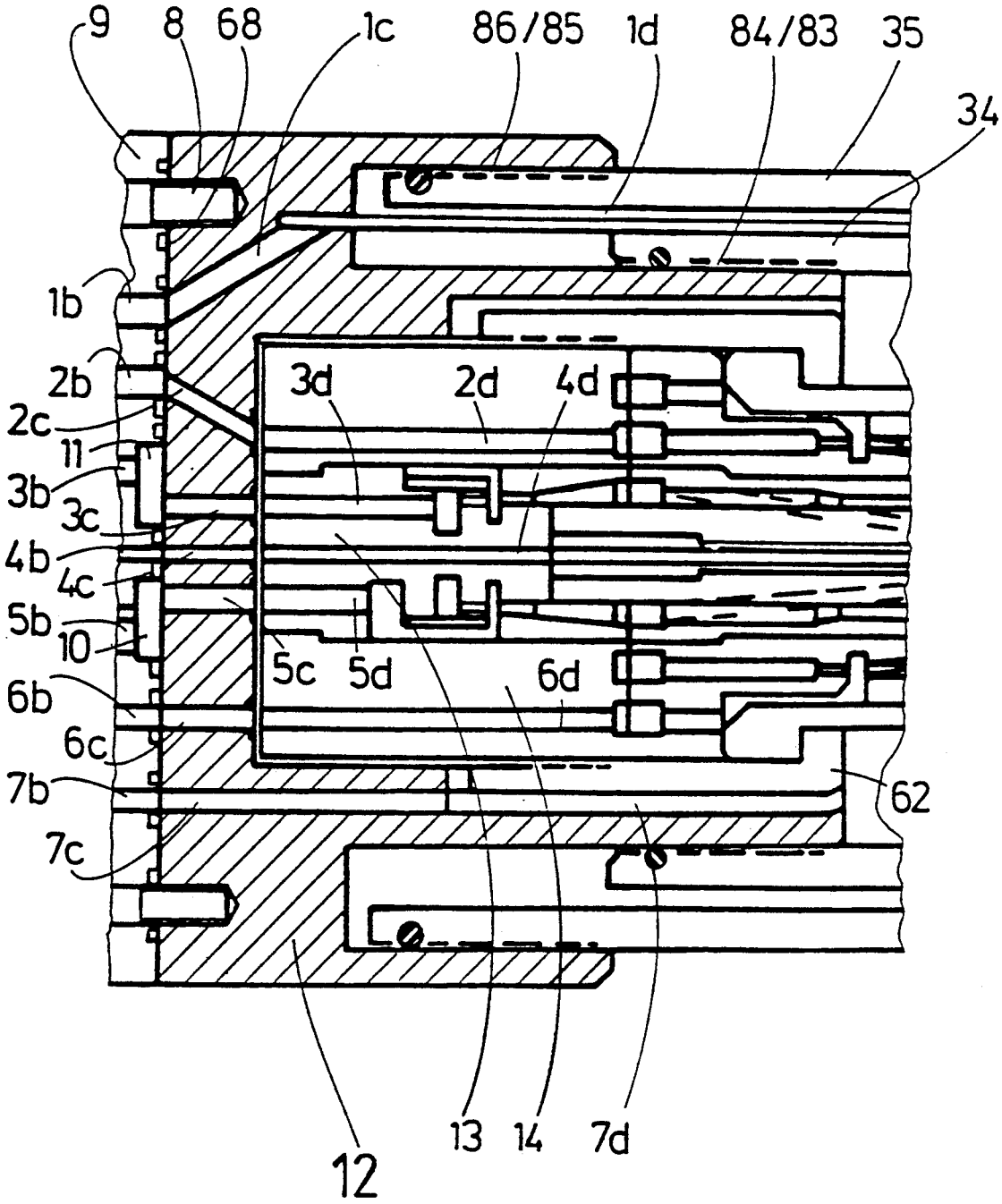
FIG. 5 shows the device base body 12.

FIG. 5 shows device base body 12. As previously described, the latter has channels 1c through 7c, which correspond with same-medium channels 1b through 7b of operating components-connector block 9.

Secondary gas channel 2c and secondary heating gas channel 6c of device base body 12 lead into same-medium channels 2d through 6d of gas mixing block support 14, while the primary gas channel 3c and primary heating gas channel 5c lead into same-medium channels 3d and 5d of injector gas mixing block 13. The charging channel 4c corresponds to charging channel 4d of injector gas mixing block 13. Cooling water advance channel 1c is connected at the same time with cooling water advance channel 1d, which is formed between internal screw sleeve 34 and external screw sleeve 35, whereby external screw sleeve 35 is screwed onto internal threading 86 and internal screw sleeve 34 is screwed onto external threading 84 of device base body 12, whereby these sleeves 34 and 35 have corresponding threads 83 and 85.

Cooling water backflow channel 7c is connected with channel 7d, which is formed between device base body 12 and press-in screw 62.

Figure 6:
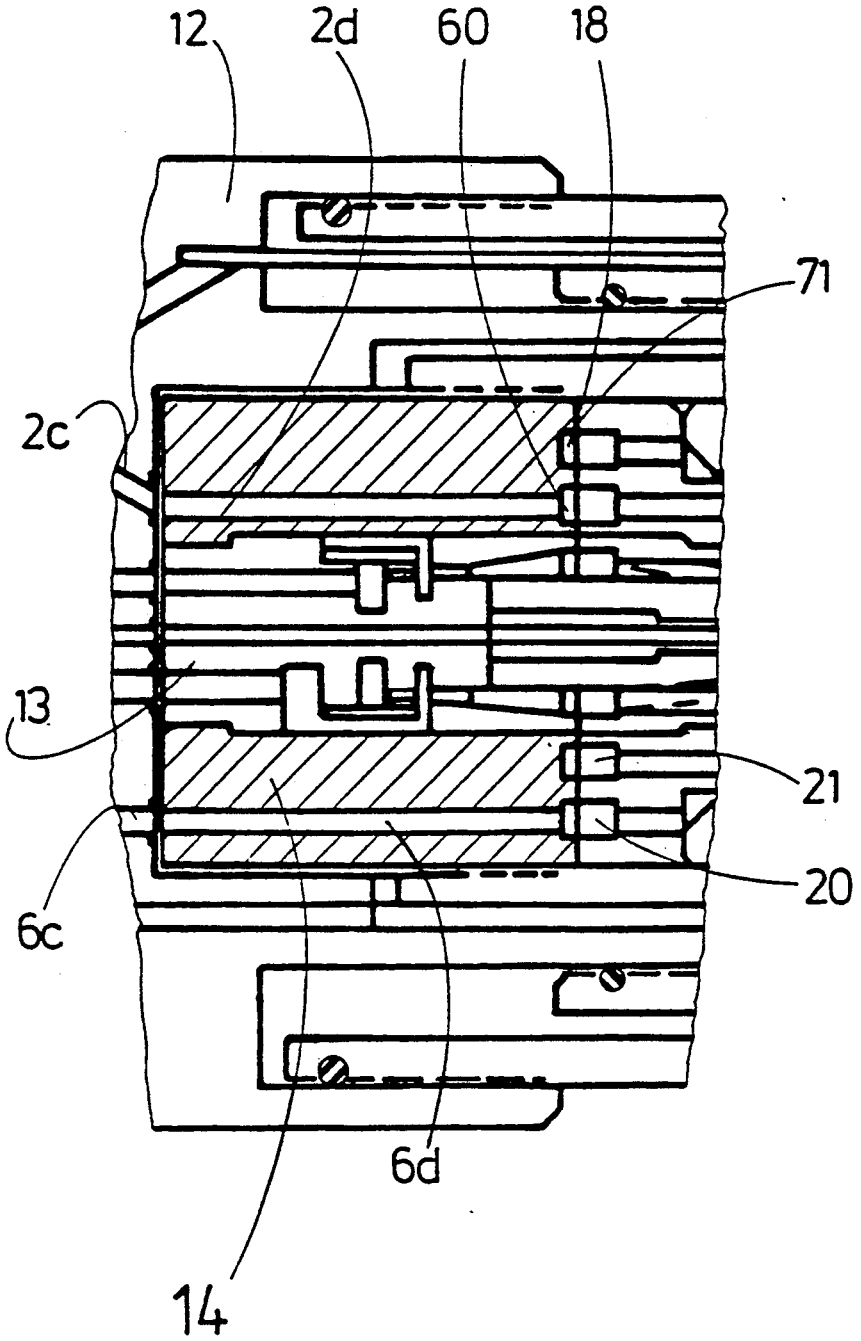
FIG. 6 shows the gas mixing block support 14.

FIG. 6 shows gas mixing block support 14. It receives centrally injector gas mixing block 13 and has secondary gas channel 2d and secondary heating gas channel 6d described above, which correspond with channels 2c or 6c of device base body 12.

On frontal side 71 of gas mixing block 14 are located radial ring grooves 18 for secondary heating gas and 60 for secondary gas, whereby channel 2d runs into radial ring groove 60 and channel 6d runs into radial ring groove 18. They in turn are connected with corresponding same-medium radial ring grooves 20 and 21 of primary combustion chamber housing 29.

Figure 7:
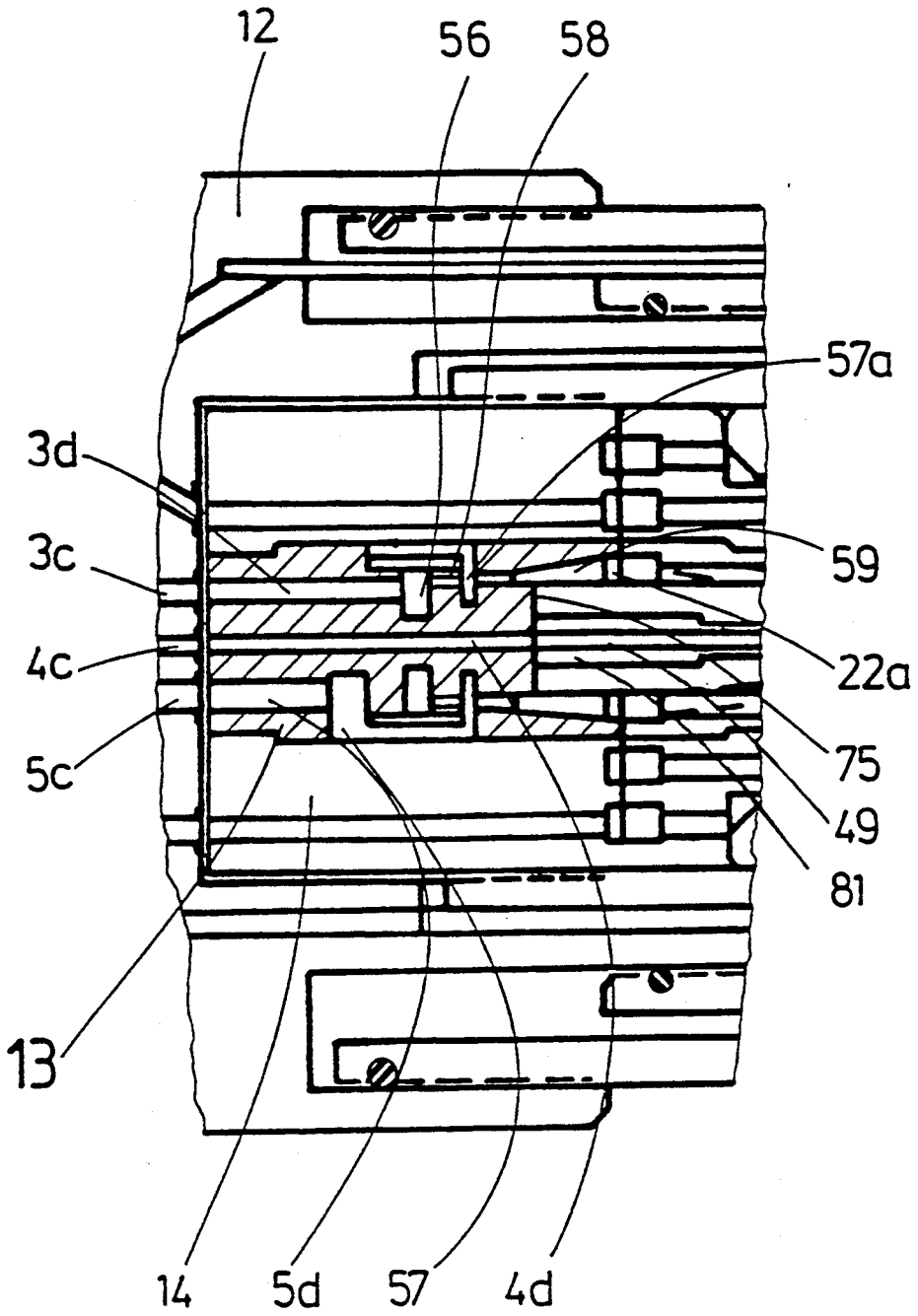
FIG. 7 shows the injector gas mixing block 13.

FIG. 7 shows injector gas mixing block 13 received from gas mixing block support 14, with its channels 3d, 4d and 5d, which as described above are connected to channels 3c, 4c and 5d of device base body 12. Channel 3d for primary gas leads into an annulus for oxygen distribution, and from there through injector pressure nozzle bores 58 into injector gap 57a, while channel 5d leads into radial annulus 57 for primary heating gas (fuel gas) and from there into injector gap 57a. The mixture then continues through injector mixing nozzle bores 59 into radial ring groove 22a, while central channel 4d for spray weld filler leads up to frontal side 65 and then merges into central channel 49 of central bore body 81.

Figure 8:
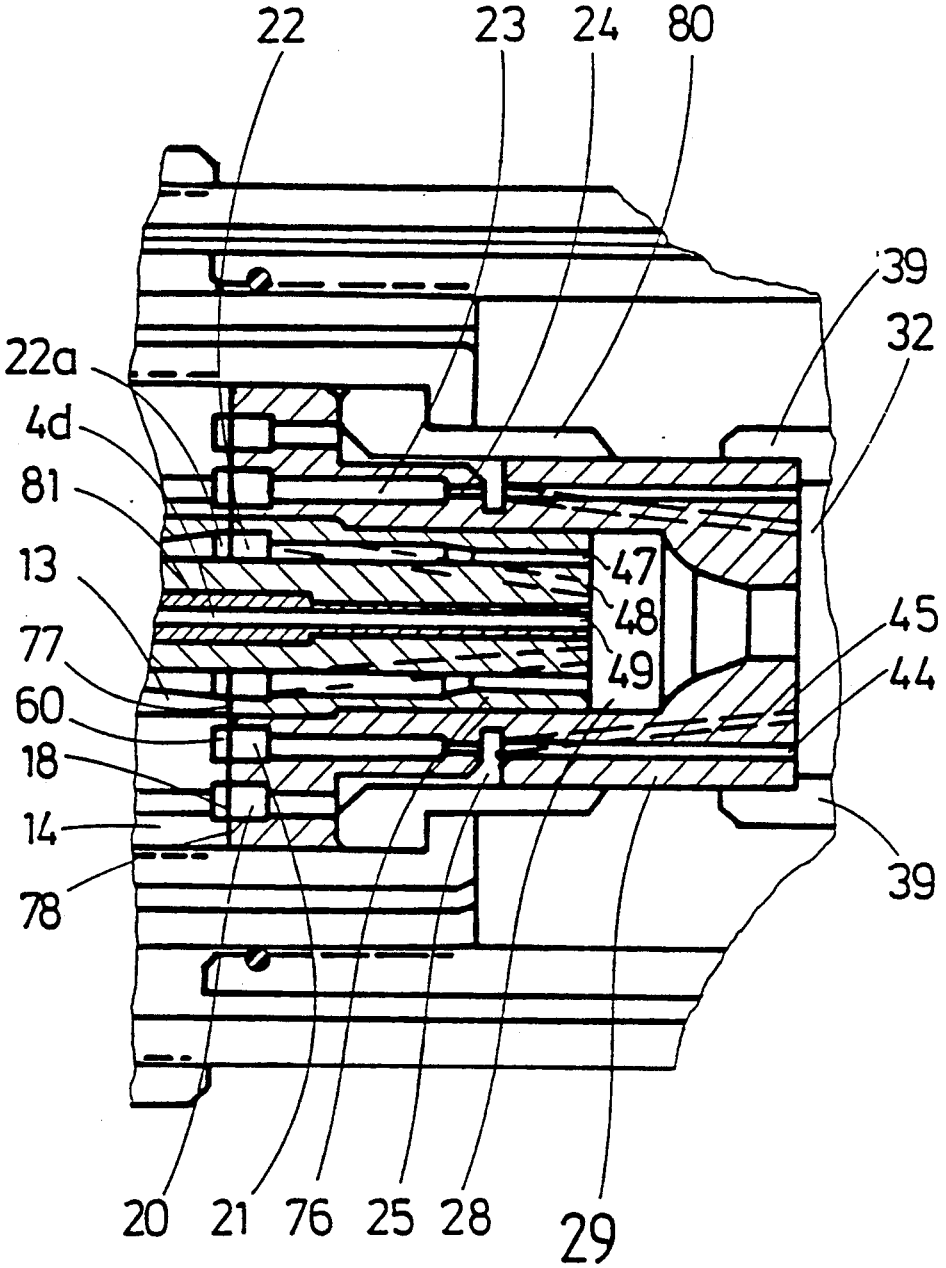
FIG. 8 shows the primary combustion chamber housing 29.

FIG. 8 shows primary combustion chamber housing 29 with its radial ring grooves 20 for secondary heating gas and 21 for secondary heating oxygen, as well as received internal part 76 with central bore body 81. This illustration clearly shows that primary combustion chamber housing 29 also completes the secondary gas or heating gas mixture. This occurs because the gas mixture fed out of injector gas mixing block 13 flows through bores 47, 48 into primary combustion chamber 28 and the secondary gas/heating gas components from the gas mixing block support are conveyed separately into primary combustion chamber housing 29 and merge together there in radial ring groove 25 (injector gap) and are carried out through primary combustion chamber 28 through bores 44, 45 into secondary combustion chamber 32 of secondary expansion nozzle body 39.

Figure 11:
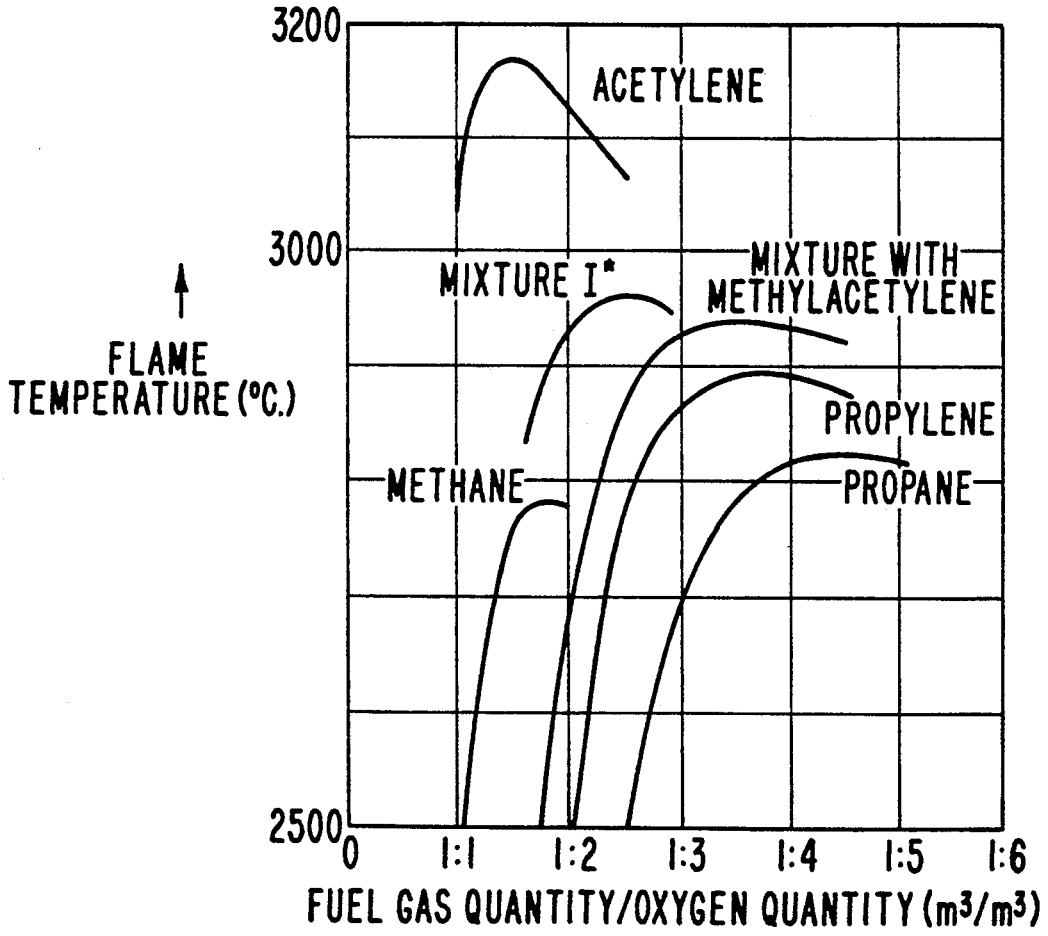
FIGS. 11–13 are diagrams of the properties of acetylene oxygen flames.
Figure 12:
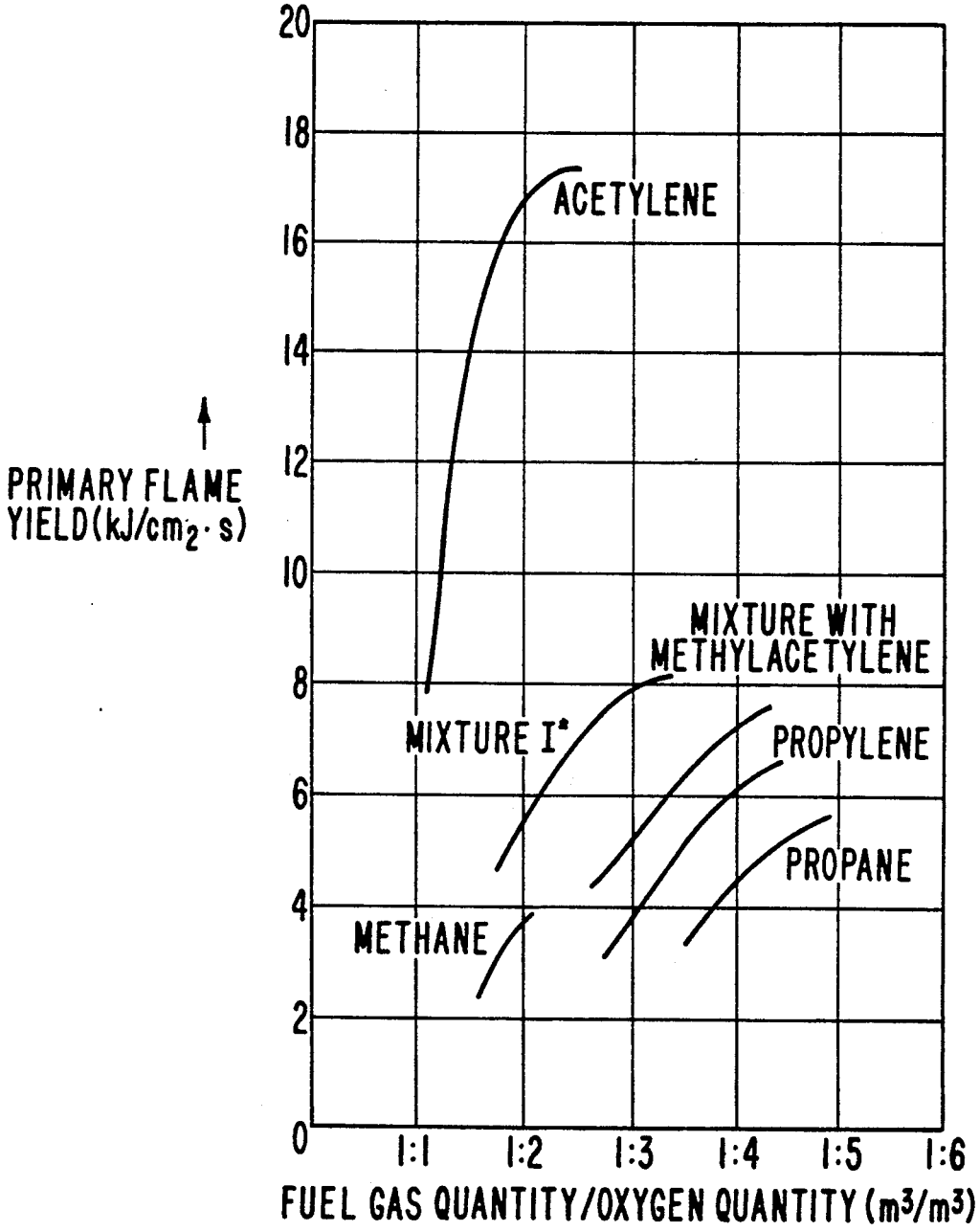
Figure 13:
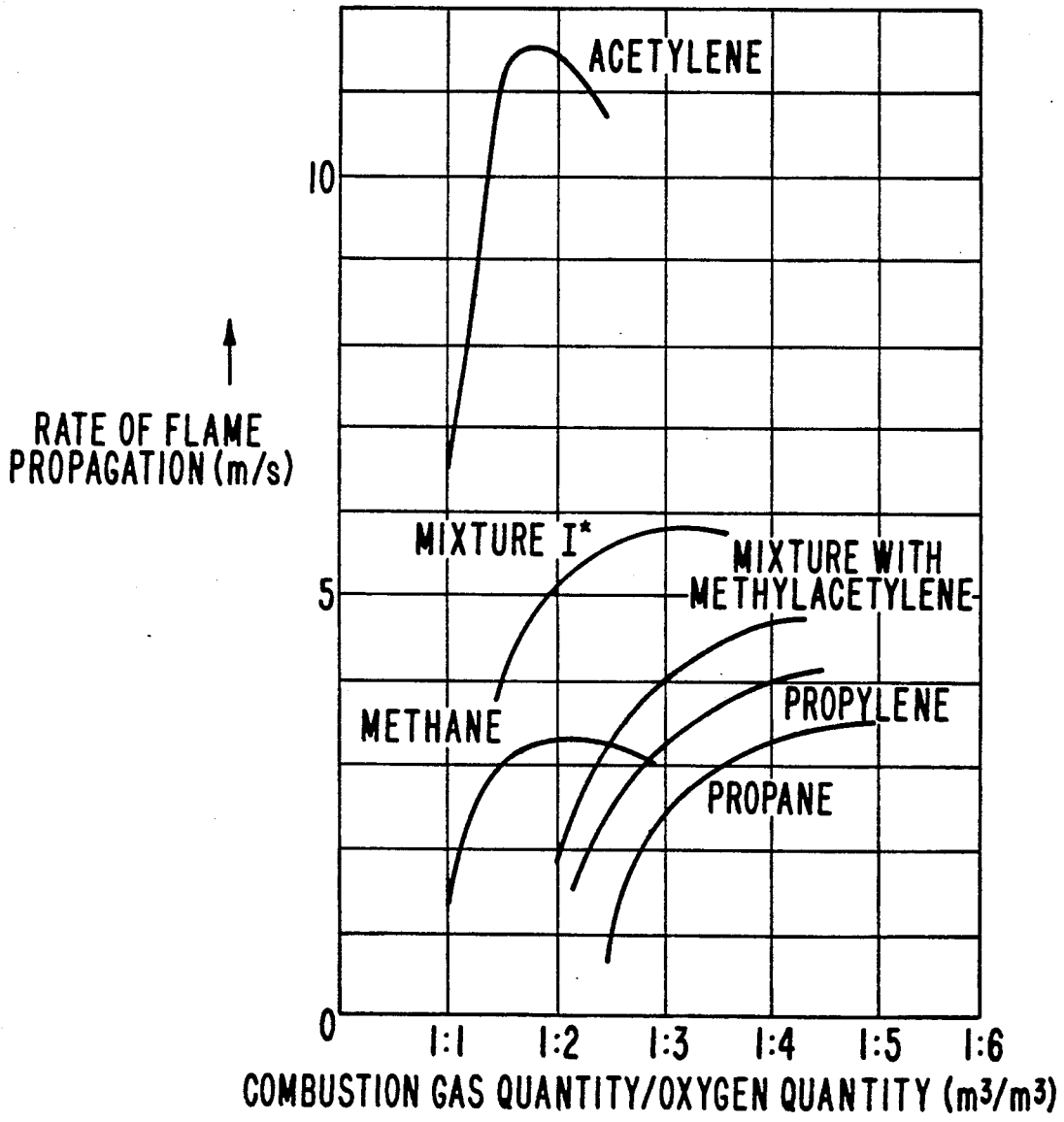

The dominant properties of the acetylene-oxygen flame will now be illustrated in reference to FIGS. 11 through 13. FIG. 11 is a diagram of the flame temperatures of fuel gas-oxygen mixtures, FIG. 12 shows the rate of flame propagation of fuel gas-oxygen mixtures and FIG. 13 indicates the primary flame yield of fuel gas-oxygen mixtures. They show that the acetylene-oxygen flame possesses dominant properties that cannot be achieved with any other fuel gas-oxygen mixture. For that reason it is ideal for thermal spraying of refractory weld fillers.

For the sake of clarity FIG. 11 compares the curve for acetylene with a mixture according to TRG 103 of 21.5 to 22.5% acetylene, 71.5 to 73.5% ethylene and 5.0 to 6.0% propylene, with a mixture of methyl-acetylene and with methane, propylene and propane.

The same comparisons are made in the diagrams shown in FIGS. 12 and 13.

The powder-powder transport gas supply in accordance with FIGS. 1 through 8 must also be explained in greater detail.

In normal cases powder and powder transport gas are supplied at room temperature at connector 4. For special applications, particularly when spraying refractory metallic or oxide ceramic powder spray weld fillers, preheated powder transport gases, such as argon, nitrogen and other gases, and preheated powder can be supplied. If this method is used, then connector **4*a* can be provided with a water cooling system (cooling water advance and backflow connectors). The powder-powder transport gas mixture is conveyed through central bore 4 and runs into primary combustion chamber 28 out of nozzle inlet bore 49**.

The non-prewarmed powder transport gas mixture is melted on by the high-speed flame and conveyed with the kinetic energy through the secondary combustion chamber, remelted by the surrounding secondary heating flame (acetylene+oxygen flame) and additionally accelerated through water cooled expansion nozzle bore 38 emerging on the face side from expansion nozzle bore 43 optimally melted or in the molten plastic state with the secondary high-speed flame at several times the speed of sound.

In the case where preheated flame spray powder and preheated powder transport gases are supplied to the burner at connector 4 (the preheating temperatures may be between 50° and 800° C.), the preheated spray weld filler is previously well melted on, when the particle is conveyed through the primary combustion chamber and arrives from the primary heating flame through the secondary combustion chamber, where it is again melted, additionally accelerated, and emerges from the expansion nozzle bore at the highest possible speed with the secondary flame. The preheating of powdered weld filler and powder transport gas to 50° C. to 800° C. before being added to the burner has several advantages over adding it cold. For example, the low temperature difference between the powder particles and the heat yield of the primary flame should be mentioned; it causes the powder to melt more satisfactorily after the same dwell time than it would if added cold. For example, an additional advantage is that the preheated powder transport gas cools the primary and secondary flame less than powder transport gas added while cold; that leads to higher flame heat yield and higher flame propagation rates.

Spray weld fillers can also be supplied through connector **4*a* through central bore 4** into the primary combustion chamber and melted.

The wire advance is regulated as a function of the melting point and the wire diameter in such a fashion that a continuous spray process can occur.

Figure 14:
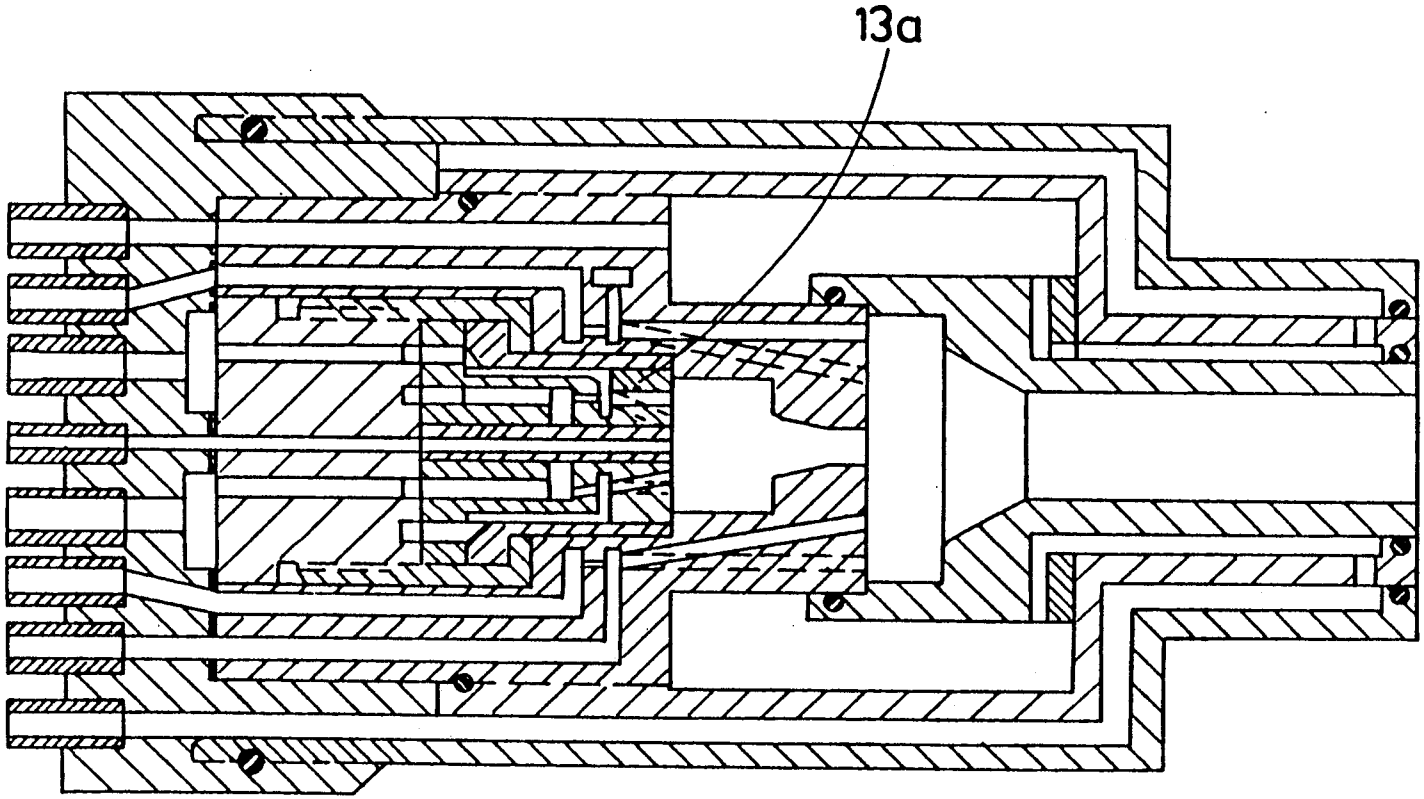
FIG. 14 shows a variation of an embodiment in which the primary heating gas mixture occurs directly in a gas mixing block according to the injector principle in the direct vicinity of the primary combustion chamber.

FIG. 14 illustrates an additional of an embodiment of the invention. In this embodiment there is a significant functional difference in that, in contrast to the embodiment in accordance with FIG. 1, in which the primary gas mixture occurs in injector gas mixing block 13, i.e. in an intermediate piece, here the primary heating gas mixture (fuel gas and oxygen) occurs directly in a gas mixing block **13*a* according to the injector principle in the direct vicinity of primary combustion chamber 28, i.e., without an intermediate piece. The descriptions provided concerning the embodiment shown in FIG. 1 concerning the other elements of the device and process refer to FIG. 14, while taking into account the adaptation of the variation of that embodiment, so that the function need not be described in additional detail, since variation of the embodiment 14** is considered to be subordinate to the general spirit of the invention.

The present invention provides a process and a device in the form of an all-gas high-speed flame spray burner for coating surfaces with any refractory wire or powdered spray weld filler, which for example makes it possible to operate without difficulty using acetylene and oxygen.

I claim:

1. A device for high-speed flame spraying of refraction wire or powder weld filler for the coating of surfaces, comprising:

a base body;

an operating components-connector block coupled to said base body;

an injector gas mixing block within said base body;

a primary combustion chamber housing defining a primary combustion chamber;

an expansion nozzle body coupled to said primary combustion chamber and defining a secondary combustion chamber;

a central bore for spray weld fillers, within said injector gas mixing block;

a secondary gas channel and a secondary heating gas channel extending from said operating components-connector block to said secondary combustion chamber; and a primary gas channel and a primary heating gas channel extending from said operating components-connector block to said primary combustion chamber;

said central bore for said spray weld fillers being surrounded by said primary gas channel and said primary heating gas channel, and extending into said primary combustion chamber, said secondary gas channel and said secondary heating gas channel extending past the primary combustion chamber in the direction of said expansion nozzle body and into said secondary combustion chamber.

2. A device in accordance with claim 1, further comprising:

a gas mixing block support for supporting said injector gas mixing block;

a press-in screw and hasp part coupled to said primary combustion chamber housing and to said gas mixing block support; and an internal screw sleeve and an external screw sleeve coupled to said base body.

3. A device in accordance with claim 2, further comprising a cooling water channel extending from said operating components-connector block, through said base body, between said internal screw sleeve and said external screw sleeve, through radial bores which extend through a downstream end of said internal screw sleeve and then merging into a cooling water backflow annulus between said expansion nozzle body and said internal screw sleeve and then into a cooling water channel leading to a cooling water backflow connector of said operating components-connector block.

4. A device in accordance with claim 1, wherein said base body includes a portion of said primary heating gas channel and a portion of said primary gas channel and wherein a portion of each of said primary heating gas channel, said primary gas channel and said central bore for said spray weld fillers extend through said injector gas mixing block, so that portions of said primary heating gas and primary gas channels in said injector gas mixing block are coupled to corresponding portions of said primary heating gas and primary gas channels in said base body, further comprising a radial annulus between said gas mixing block support and said injector gas mixing block, wherein one of said primary heating gas and primary gas channels runs into the radial annulus, while said central bore for spray weld fillers extends to a downstream face side of said injector gas mixing block.

5. A device in accordance with claim 4, further comprising a cooling water channel extending from said operating components-connector block, through said base body, between said internal screw sleeve and said external screw sleeve, through radial bores which extend through a downstream end of said internal screw sleeve and then merging into a cooling water backflow annulus between said expansion nozzle body and said internal screw sleeve and then into a cooling water channel leading to a cooling water backflow connector of said operating components-connector block.

* * * * *